United States Patent [19]

Carson

[11] 4,257,583

[45] Mar. 24, 1981

[54] CLAMPING DEVICE

[76] Inventor: James W. Carson, Rte. 1, Box 62, Fayetteville, Ark. 72701

[21] Appl. No.: 125,870

[22] Filed: Feb. 29, 1980

[51] Int. Cl.[3] ..... B25B 1/14

[52] U.S. Cl. ..... 269/32; 269/228

[58] Field of Search ..... 269/23, 24, 27, 32, 269/228

[56] References Cited

U.S. PATENT DOCUMENTS

| | | | |
|---|---|---|---|
| 2,165,614 | 7/1939 | Cook et al. | 269/32 |
| 2,530,085 | 11/1950 | Shaff | 269/32 |
| 3,027,155 | 3/1962 | Paterson | 269/32 |
| 3,347,542 | 10/1967 | Mericle | 269/32 |

*Primary Examiner*—Robert C. Watson

*Attorney, Agent, or Firm*—Robert R. Keegan

[57] ABSTRACT

There is disclosed a clamping device primarily for clamping workpieces in production forming presses or other production tools which includes a toggle mechanism powered by an air cylinder or other power actuator and cooperating in tandem with a hand toggle mechanism; the hand toggle mechanism provides a short travel at a very high force for the moving one of a pair of clamping jaws. The hand toggle mechanism must be moved through its travel to a locked position to actuate the powered toggle mechanism and preferably a valve or other control for the power actuator is positioned to operate upon locking of the hand toggle mechanism. The hand toggle mechanism is spring biased to unlock and open after the locking force imparted by the power toggle mechanism has been released. The release of the power toggle mechanism is by a hand operated valve or a press operated valve so that manual opening of the clamping jaws is not required on the part of the operator.

10 Claims, 10 Drawing Figures

CLAMPING DEVICE

This invention relates to two-stage clamping mechanisms generally, but more specifically to a work holding device for industrial press forming operations or other production forming operations on tubular metal parts or the like. The basic mechanism has potential applications in industry where parts are to be formed by a press or other tool and are to be placed by hand in a clamp having a high clamp force, with this operation being repeated a large number of times. The apparatus according to the invention has important features which give it simplicity, capability of fast and low effort operation, and an especially important high degree of operator safety.

Production clamping devices or holding vises obviously need to be rapid in operation, and well-known screw vise apparatus would be quite unsuitable for this application. Production workholding vises are known wherein pneumatic or hydraulic cylinders are utilized to provide high clamping force with relatively little operator effort. In the situation at hand where the workpiece is hand loaded by the operator the ordinary pneumatic or hydraulic cylinder powered clamp presents an inherently dangerous situation. Typically clamping jaws must open wide enough to inadvertently admit a hand or fingers between the clamping faces and the thousand pounds or more of force necessary to confine the workpiece during a forming operation is great enough to permanently injure an inattentative operator to the point of loss of fingers or complete loss of use of a hand.

The clamping device of the present invention is a simple mechanism which combines a hand operated toggle and a power operated toggle in such a way that the great force of the power clamping operation cannot inadvertently be imposed on the operator's fingers or hands to produce injury. Force of the cylinder in the present invention acts over a distance of no more than about 0.100 inches so that permanent injury to a finger or hand is virtually impossible. The hand toggle mechanism and the power toggle mechanism are connected in tandem so that the great force of the power toggle cannot be applied to the clamp until the hand toggle has been locked over center. A further advantage of the apparatus of the invention resides in the face that the hand toggle may be spring loaded for self-unlocking and self-retracting; the spring loading of the hand toggle is, of course, much less forceful than the force of the power toggle so that so long as the power toggle is locked the spring loading of the hand toggle is ineffective. As soon as the power toggle is unlocked and retracted the spring loading of the hand toggle takes over to unlock and retract the hand toggle. The power toggle is preferably automatically actuated to the extended and locked position by a valve or other sensor which responds to extension and locking of the hand toggle.

A four-link version of the apparatus of the invention and a three-link version of the apparatus of the invention are shown. The basic operation of the two versions is the same but they are different in certain respects which may be found to be advantageous for particular situations.

Clamping apparatus or other force supplying apparatus is known which utilizes a two-stage mechanical arrangement. For example, U.S. Pat. No. 2,656,748 to Hugo, et al, shows a two-stage force supplying apparatus consisting of a cylinder operated toggle for a large movement followed up by a fluid cylinder operated screw to apply a high clamping force. Another U.S. Pat. No. 2,530,085 to Shaff, shows a mechanism with a hand operated ratchet mechanism for gross movement which is followed up by a fluid pressure operated toggle mechanism. Other pressure applying devices utilizing toggles and/or fluid pressure cylinders are shown in U.S. Pat. Nos. 2,708,381 to Olsen, 3,095,190 to Freund, 3,927,872 to Sessody, and U.S. Pat. No. 3,941,362 to Arnold, et al. However, while these patents shown individual features and mechanisms which are similar to portions of the apparatus of the invention, none of these prior patents recognize and are directed to the problem of safely applying large forces for clamping workpieces in production forming tools; neither is there any suggestion of apparatus in this prior art which is directly applicable to the problem.

In addition to providing the advantages and features described above it is an object of the present invention to provide a vise or clamping mechanism wherein the gross movement of the movable jaw of the mechanism is produced by a hand toggle and the smaller forceful clamping movement is provided by a power actuated toggle in tandem with the hand toggle.

It is another object of the invention to provide a clamping mechanism wherein the locking of a hand toggle by reaching its over center position automatically initiates the operation of an in tandem power toggle to apply clamping force of high magnitude.

It is still another object of the present invention to provide a clamping mechanism including a pair of toggles in tandem wherein release of the shorter throw of one of the toggles permits the larger throw toggle to be unlocked and retracted by the action of a spring bias mechanism.

It is yet another object of the present invention to provide a clamping mechanism operated by a pair of toggles in tandem wherein one of the toggles has a short travel and a high force producing capability such that, due to the short travel of the toggle, it is virtually impossible for an operator to sustain serious injury to his fingers or hands by the action of the forceful toggle mechanism.

Other objects and advantages of the present invention will be apparent from consideration of the following description in conjunction with the appended drawings in which.

Figure 1:
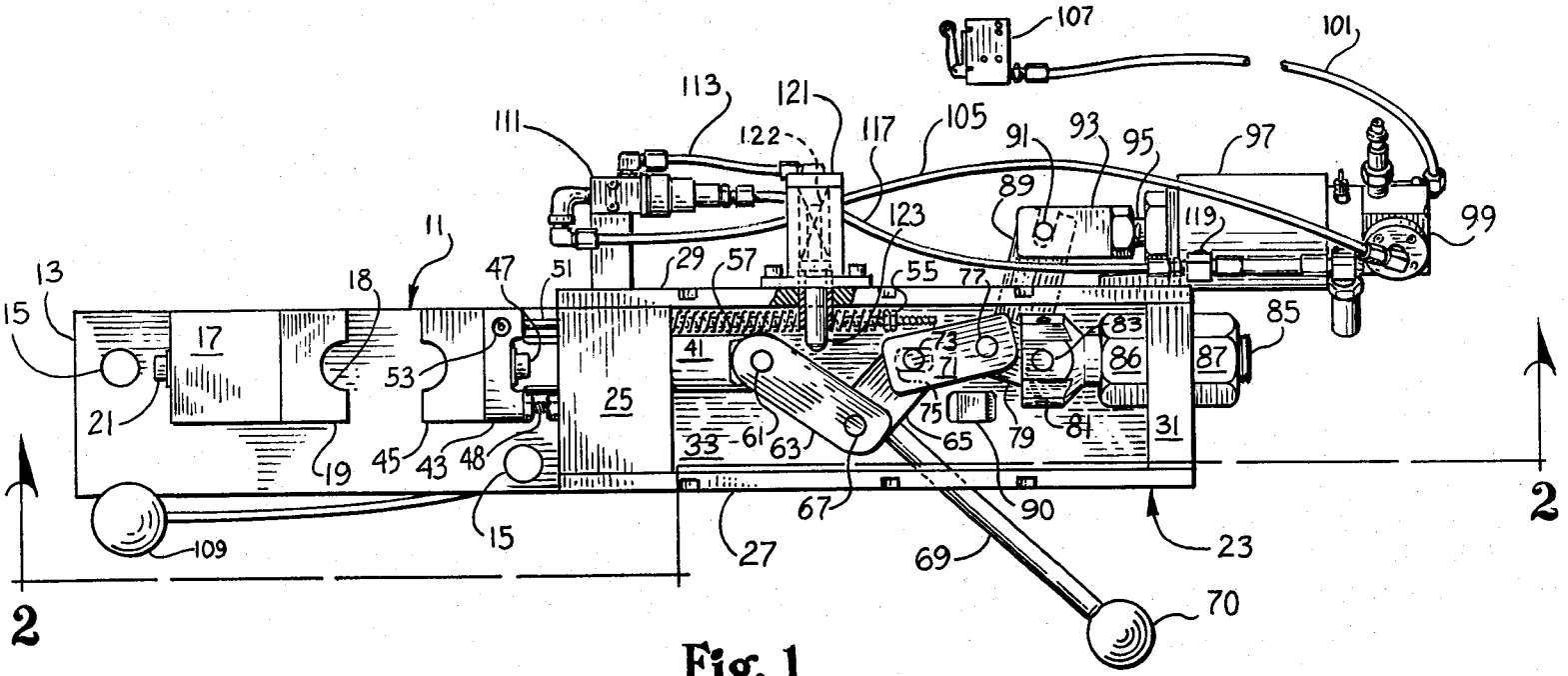
FIG. 1 is a top plan view of clamping apparatus according to the invention, with the cover removed to show the toggle linkage of the apparatus.
Figure 3:
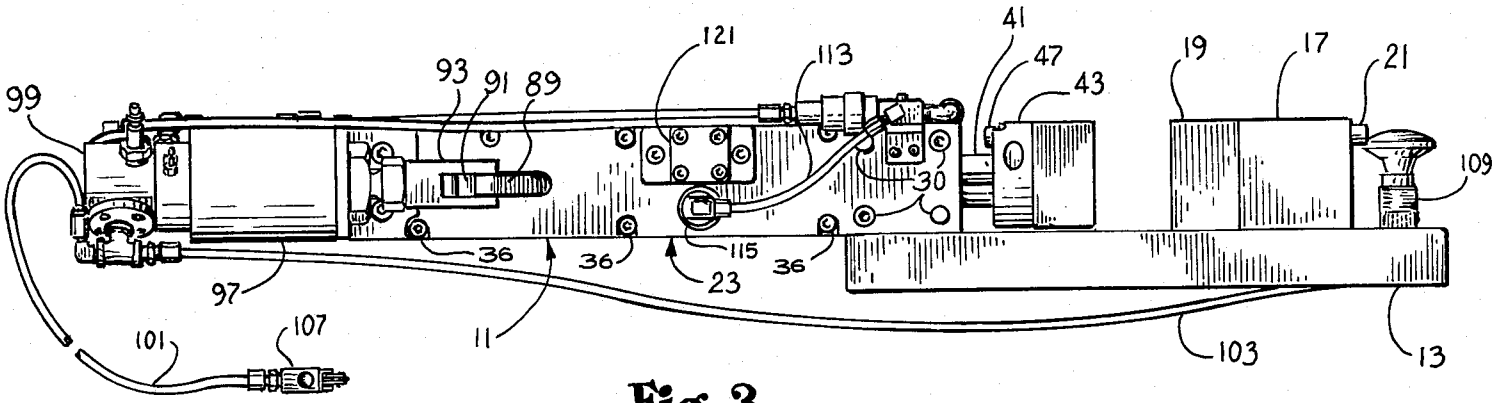
FIG. 3 is a rear side elevational view of the apparatus of FIG. 1.
Figure 2:
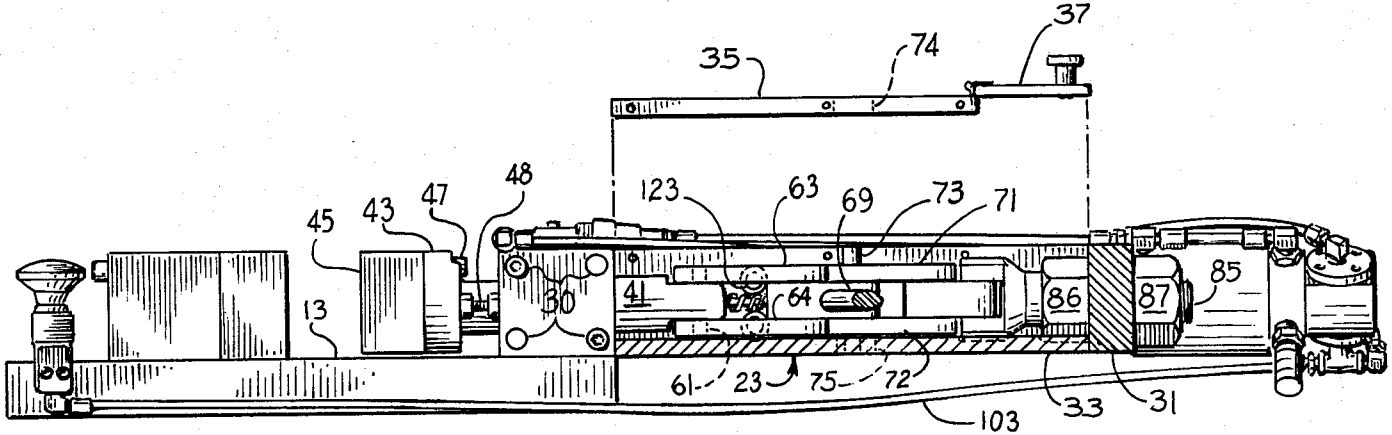
FIG. 2 is a sectional view of the apparatus of FIG. 1 taken along the line 2—2 in FIG. 1 and in which the cover portion of the apparatus is shown in exploded view.

Referring now to the figures and particularly to FIGS. 1, 2 and 3, a clamping apparatus 11 according to the invention is shown having a base plate 13 which is adapted to be fastened in a forming press, drill press, or other production tool where a workpiece is required to be held in position during a forming, drilling, or other operation.

Holes 15 are provided in base plate 13 for securing clamp 11 in the forming press or other production apparatus by means of machine bolts (not shown). Of course, the base plate 13 may be secured on the forming press by any other suitable means. A stationary block 17 is secured to base plate 13 by welding, bolting or other suitable means and it has removably secured thereto a fixed workpiece jaw 19; jaw 19 may be attached to block 17 by a bolt 21.

Jaw 19 is shown having a semi-cylindrical indentation 18 to adapt it to grasp a cylindrical workpiece. It will be understood that the shape of the jaw 19 will be determined by the workpiece to be grasped and, typically, a number of different types of jaws 19 would be available for attachment to block 17 as determined by the nature of the workpiece which was to be operated on.

Secured to the base plate 13 is a linkage housing 23 which includes a guide block 25 welded, bolted or otherwise secured to base plate 13. Housing 23 forms a frame for the linkage mechanism and includes a front side plate 27 and a rear side plate 29 which are secured to respective sides of guide block 25 by bolts 30. A back plate 31 is secured between sides 27 and 29, by further bolts 30, and completes the frame for the linkage mechanism. The housing 23 is completed by a lower cover 33 and an upper cover 35 secured in place by bolts 36. Cover 35 is readily removable for access to the linkage and also, preferably, has a hinged door 37 giving ready access to the interior of the housing for a purpose which will later be explained.

A sliding cylindrical shaft 41 extends through an opening in guide block 25; the opening in block 25 will normally be provided with a bronze bushing or other friction reducing device. Permanently secured to shaft 41 is a mounting block 43. Mounting block 43 has provisions for attachment of a movable jaw 45 which is similar to fixed jaw 19 as illustrated in FIG. 1. Like jaw 19, jaw 45 will be shaped to conform to a particular workpiece upon which a forming operation or other operation is to be performed. Jaw 45 may be attached to mounting block 43 by a bolt 47.

An adjustable stop 48 is preferably provided for the mounting block 43 and may consist, for example, of a machine bolt threaded into a tapped opening in guide block 25, together with a locking nut to lock it in position to provide a stop at the desired location for mounting block 43. This determines the maximum opening between jaw 19 and jaw 45.

A return rod 51 is secured in the back face of mounting block 43 by a set screw 53 or other suitable means. Rod 51 extends freely through an opening in guide block 25 and has a pair of nuts 55 threaded on the free end thereof. A coil compression spring 57 is placed over rod 51 and bears against the back face of block 25 and against one of the nuts 55 so that mounting block 43 is urged to the retracted position or to the right in FIG. 1. The force of spring 57 on mounting block 43 may be adjusted by unlocking, rotating and relocking nuts 55 so that they are at the desired position on the threaded end of rod 51.

Pivotally coupled to the rear of shaft 41 by a pin 61 are a pair of links 63 and 64. Links 63 and 64 operate together to form one-half of a hand operated toggle linkage, the other half of which is provided by a link of 65 pivotally joined to links 63 and 64 by a pin 67. Friction reducing means may be provided for pins 61 and 67 and other similar pins in the apparatus. Such means may take the form of bronze bushings, of grease fittings built into the pins, or of ball-bearings or roller bearings.

An operating arm 69 is secured to the link 65 near the central portion thereof by welding or by threaded engagement in an opening in link 65. A handle 70 is threadedly engaged on the threaded end of arm 69. Arm 69 passes through a slot (indicated by hidden lines) in plate 27.

A pair of power toggle links 71 and 72 are pivotally connected to link 65 by a pin 73 in the manner previously described for other links. Pin 73 is however longer than pin 61 and 67 and extends partly into slots 74 and 75 in the top cover 35 and the bottom cover 33 respectively. The engagement of pin 73 in slots 74 and 75 maintains pin 73 as a stationary pivot point for link 65 as long as pin 77 is stationary.

The pair of links 71 and 72 are seen to act as a single link, and links 71 and 72 are pivotally connected by pin 77 to toggle link 79. Link 79 is pivotally connected to a clevis 81 by means of a pin 83. Clevis 81 is attached to the end of a threaded shaft 85 which passes through a hole in rear wall 31. Large nuts 86 and 87 serve to position shaft 85 (and pin 83) and lock it in place relative to rear wall 31 and thus securely fixed in position relative to base plate 13 and fixed jaw 19. The adjustability of the position of shaft 85 and clevis 81 is quite small, only amounting to a small fraction of an inch. Large adjustments are not necessary because jaws 19 and 45 will be standardized so that the position of mounting block 43 relative to stationary block 17 in the fully clamped position of the apparatus will be the same in all cases, at least within a small fraction of an inch.

Link 79 has an operating arm 89 extending therefrom. The slot in operating arm 89 engages a pin 91 in a clevis 93 mounted on the end of the shaft 95 of an air powered cylinder actuator 97. The shaft 95 is shown in its retracted position in FIG. 1.

Cylinder 97 has a built-in remotely operated valve 99 which is a bleed operated valve for which air lines 101 and 103 are remote retraction bleed lines and air line 105 is a remote extension air line. The retraction of cylinder 97 is directly controlled by the operation of either of two bleed valves 107 and 109. Valve 107 is a roller-arm cam operated valve adapted to be placed on the forming press to be momentarily opened upon the completion of the forming operation. As will later be more fully explained valve 107 thereby retracts cylinder 97 automatically upon completion of the forming operation causing release of the clamping device for removal of the workpiece by the operator. Valve 109 is a hand operated valve performing the same function so that the operator may release the clamp jaws independently of the forming press operation.

Retract air line 105 passes through a normally closed pressure operated valve 111 to an air line 113. Air line 113 connects to a cam operated bleed valve 115 secured in the side 29 of housing 23 and has its operating member located to be depressed by link 64 to operate bleed valve 115 when the hand toggle mechanism including link 64 is extended and locked. However, bleed valve 115 is ineffective so long as normally closed pressure operated valve 111 is closed. Valve 111 has its operating pressure supplied through line 117 from the retract pressure port 119 of cylinder 97. Bleed valve 115 is thus prevented from operating cylinder 97 except when pressure is applied to the retract pressure port 119 by valve 99. Pressure operated valve 111 prevents a continuous bleed from valve 115 which would prevent operation of valve 99 for retracting cylinder 97.

A spring cell 121 mounted on side 29 of housing 23 contains a spring (shown schematically only) which urges finger 123 to an extended position within housing 23 where it contacts the side of link 63.

The setup for the clamping device for a particular forming operation proceeds as follows. The clamping device may be more or less permanently attached to a punch press by means of bolts through holes 15 in a base 13. If not already so attached the first step would be to attach the base portion of the device to the press. Jaws 19 and 45 are selected to match the configuration of the particular workpiece to be operated on. The jaws are attached to fixed block 17 and mounting block 43.

If desired the maximum opening of the jaws may be adjusted by adjustment of adjustable stop 48. The required tightness of the jaws when closed on the workpiece is adjusted, if necessary, by setting of nuts 86 and 87. Normally the adjustment of the retraction force of spring 57 will not be necessary but may be accomplished by removal of cover 35. The hinged door 37 of cover 35 makes it unnecessary to remove cover 35 for adjustment of nuts 86 and 87.

Preferably holes 15 are large enough to provide clearance around the attachment bolts (not shown) so the clamping device can be shifted slightly for accurate alignment of the workpiece with the press ram. Thus it will be seen that setting up the clamping device for a different operation is a simple procedure requiring but a few minutes.

Figure 4:
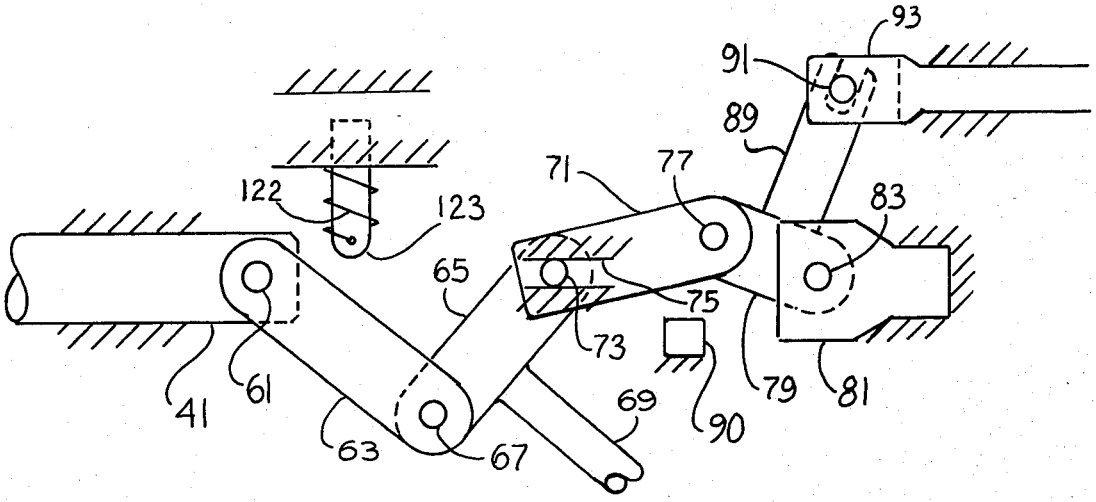
FIG. 4 is a schematic view of the linkage of the apparatus of FIG. 1 with both toggles retracted.
Figure 5:
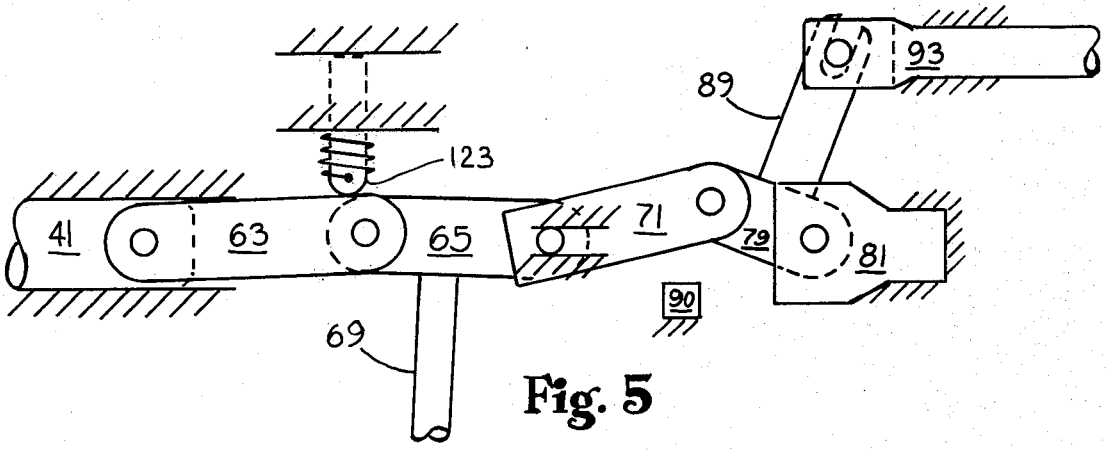
FIG. 5 is a schematic view of the apparatus of FIG. 1 with the hand toggle mechanism extended and the power toggle mechanism retracted.
Figure 6:
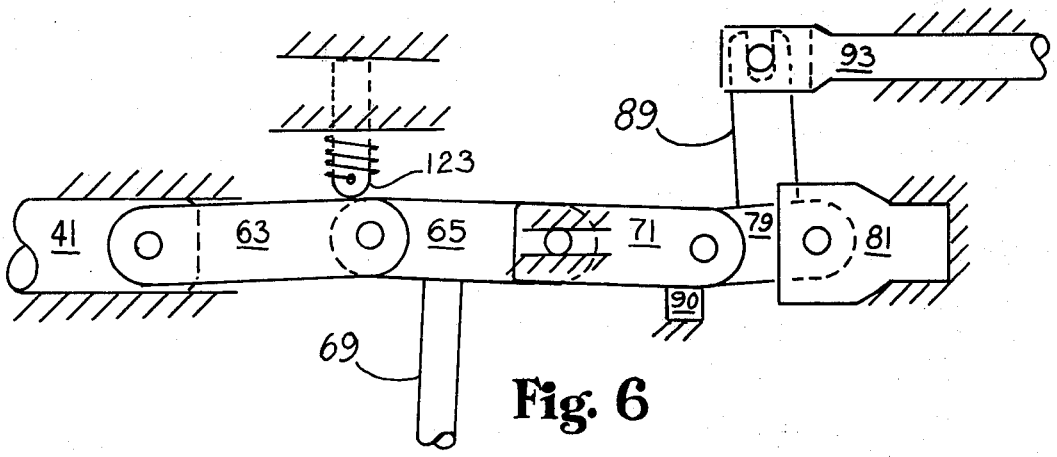
FIG. 6 is a schematic view of the apparatus of FIG. 1 with both toggle mechanisms extended and locked.

The operation of the apparatus of FIGS. 1, 2 and 3 may be better understood by reference to the schematic diagrams of FIGS. 4, 5 and 6. FIG. 4 shows schematically the position of the mechanism of FIG. 1 at the start of a forming operation. The shaft 41 is retracted so that the jaws 19 and 45 would be opened to receive a workpiece. Typically the operator will place a workpiece between the jaws with his left hand while closing the jaws by moving arm 69 to the left with his right hand on handle 70; the closing of the jaws also compresses spring 57 (not shown in FIGS. 4–6). The adjustment of nuts 86 and 87 is preferably such that motion of arm 69 to extend toggle links 63 and 65 brings jaw 45 to about 0.080 inches from contact with the stationary jaw 19. The workpiece is trapped within the jaws but no substantial force is applied to the workpiece. After full movement of the arm 69 the position of the linkage is as shown in FIG. 5 where it will be noted that finger 123 has been contacted by link 63 and spring 122 urging finger 123 outward is compressed. Finger 123 is provided with a stop to prevent further retraction of finger 123 and serving to provide a stop for the position of link 63 and the hand toggle mechanism.

Throughout this operation the pivot pin 73 at the rear end of link 65 is maintained in a stationary position by the combined restraint of link 71 and slots 74 and 75. As link 63 forces finger 123 to retract, link 64 operates bleed valve 115. Since pressure has been applied to retract shaft 95, pressure is also applied to pressure operated valve 111 causing it to be open so that bleed valve 115 operates bleed operated valve 99 to remove pressure from port 119 and apply pressure (through internal connections not shown) to extend shaft 95 of cylinder 97. This initiates the action which moves the linkage to the position shown in FIG. 6. That is, arm 89 is moved counter-clockwise carrying link 79 and link 71 into the over center position where they are stopped by stop block 90. As the toggle linkage formed by link 71 and 79 extends and locks over center the pin 73 moves a very small distance to the left in FIG. 6 thereby moving links 63, 64 and 65, shaft 41 and movable jaw 45 by the small remaining distance to completely close the movable jaw 45 against the stationary jaw 19 (a distance of 0.080 inches, for example).

Thus it will be seen that the two toggle mechanisms are effectively in tandem and the motion provided by operation of links 63, 64 and 65 with arm 69 is thereafter supplemented by smaller motion due to the extension of the linkage comprising links 71 and 79 resulting from operation of the cylinder 97. In this operation the pin 73 is restrained from motion perpendicular to the center line of the linkage by slots 74 and 75 while at the same time permitting the small motion necessary to complete the closing of the jaws with great force available from the cylinder 97 as amplified by the toggle linkage including links 71 and 79. Both of the toggle mechanisms are locked over center in a position shown in FIG. 6 and will remain in that position so long as the shaft 95 of cylinder 97 is extended.

Either by operation of the valve 107 by the forming press or by hand operation of valve 109, bleed operated valve 99 may be operated to cause retraction of shaft 95. It will be recalled that bleed valve 115, while still operated, is rendered ineffective by the closing of pressure operated valve 111 when pressure is no longer present at retract pressure port 119. When cylinder 97 retracts shaft 95, the apparatus commences to move from the position shown in FIG. 6 to that shown in FIG. 6, but before the FIG. 5 position is reached the force on the hand toggle linkage including links 63, 64 and 65 is released so that the force of spring 122 acting through finger 123 can push the junction of links 63 and 65 from the over center position toward the retraction position. Once the links 63 and 65 are no longer over center, spring 57 takes over by urging mounting block 43 and shaft 41 to the right and causing retraction of the hand toggle linkage with motion of arm 69 to the right to its original starting position. Meanwhile the powered toggle linkage including links 71 and 79 has also retracted to the position shown in FIG. 4. This restores the apparatus to the original starting position at which point the operation can be repeated.

From the foregoing explanation it will be seen that the apparatus provides operation which is characterized by simplicity, safety and efficiency. The operator can place the workpiece in the jaws and move the arm to close the jaws in essentially one movement without danger of injury to hand or fingers due to the high force of the pneumatic powered final clamp stage. The operator is required to make no further motion to initiate the power clamping and may immediately move to actuate the forming press or other forming, drilling or cutting mechanism. The release of the clamp is readily arranged to be automatic through a press-operated bleed valve or may be accomplished by manual operation. Return of the operating arm by the operator is unnecessary, and he can already be in the process of moving the next workpiece toward the jaws of the clamping apparatus. The exposure of the operator to the high force of the clamping operation is virtually eliminated since the motion and the final power clamping operation is over a distance of not more than about 0.100 inch.

Figure 10:
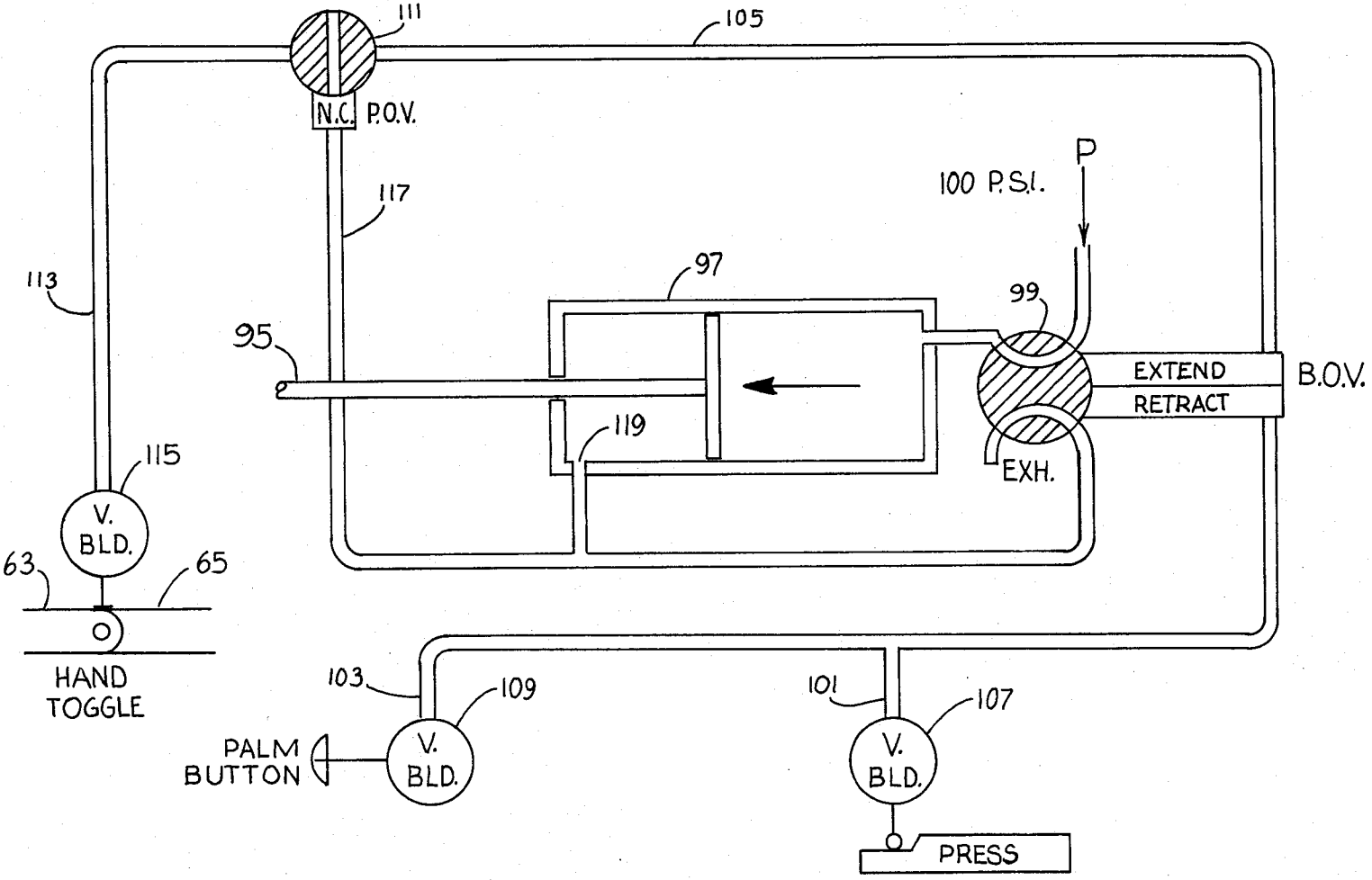
FIG. 10 is a schematic diagram of the fluid pressure control and actuation apparatus in the apparatus of FIG. 1.

A schematic diagram of the pneumatic valves and controls is shown in FIG. 10. It will be appreciated, however, that the specific form of the controls for the apparatus is subject to wide variation and is not limited to the specific arrangements shown. For example, hydraulic apparatus rather than pneumatic apparatus could be employed, and the apparatus could be partially elctrical rather than solely pneumatic as illustrated.

As shown in FIG. 10 the cylinder 97 has a shaft 95 (shown in FIG. 10 between the retract and extend positions). A pilot valve which is a bleed operated valve 99 has two positions, the extend position being shown in FIG. 10 and a position rotated 90 degrees counterclockwise which is the retract position. Two bleed valves 109 and 107 are connected to the retract port of the bleed operated pilot valve 99. Valve 109 is a palm button operated valve and valve 107 is a cam operated valve adapted to be operated by the press. A bleed valve 115 is operated by the hand toggle being in the over center position. The bleed valve 115 is connected to the extend port of the bleed operated pilot valve 99 but its operation can be defeated by pressure operated valve 111 which is normally closed in the absence of pressure to the retract pressure port 119. Summarizing the operation of the apparatus shown in FIG. 10 which has been previously explained, locking of the hand toggle including links 63 and 65 operates bleed valve 115 and if valve 111 is open, as it would be when the shaft 95 of cylinder 97 is retracted, then operation of bleed valve 115 causes pilot valve 99 to move to the extend position. As soon as it does so however, pressure operated valve 111 closes so that bleed valve 115 is no longer effective. Then when either bleed valve 107 or bleed valve 109 is operated there is no signal from bleed valve 115 and pilot valve 99 will operate to the retract position causing shaft 95 of cylinder 97 to retract and restore the pneumatic system to the starting position.

Figure 7:
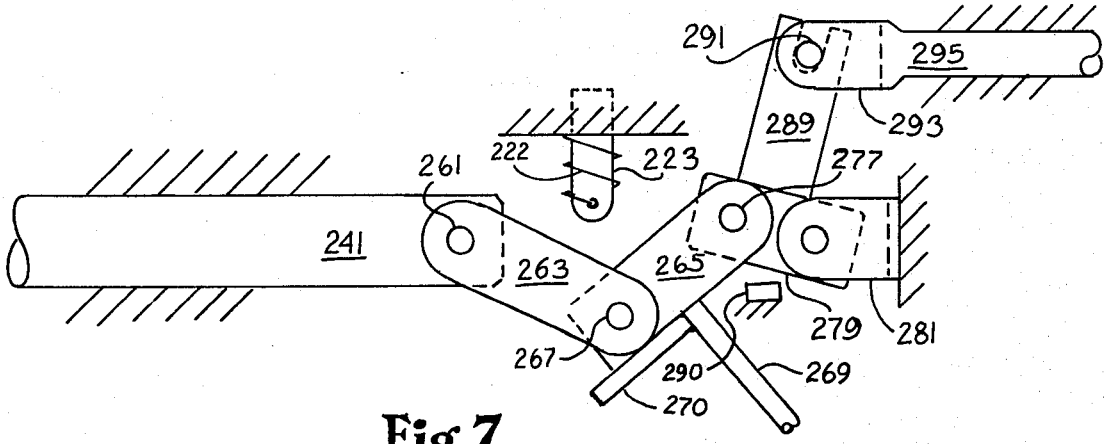
FIG. 7 is a schematic view of an alternative form of linkage which may be incorporated in the apparatus of FIG. 1 and shows both toggles retracted.
Figure 8:
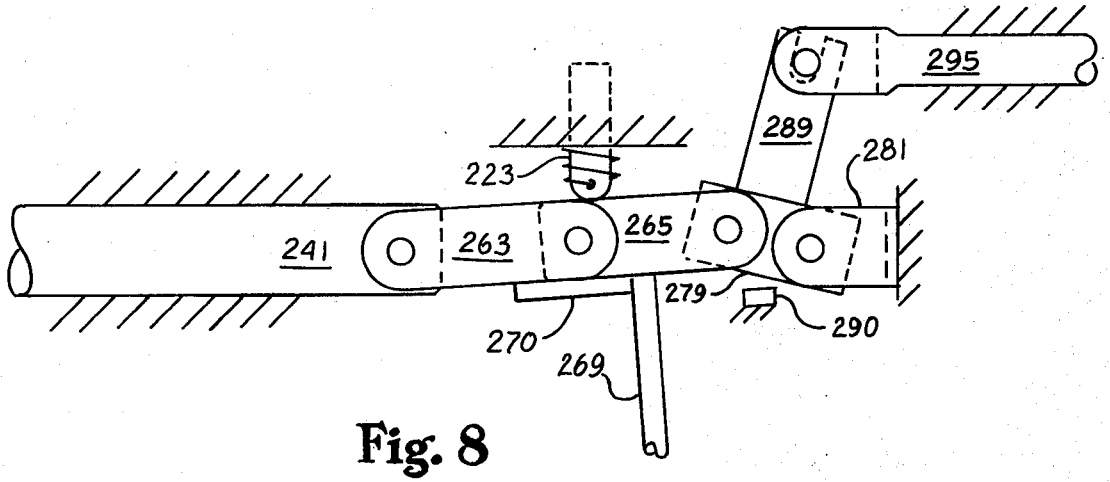
FIG. 8 is a schematic view of the alternative linkage of FIG. 7 with the hand toggle mechanism extended and the power toggle mechanism retracted.
Figure 9:
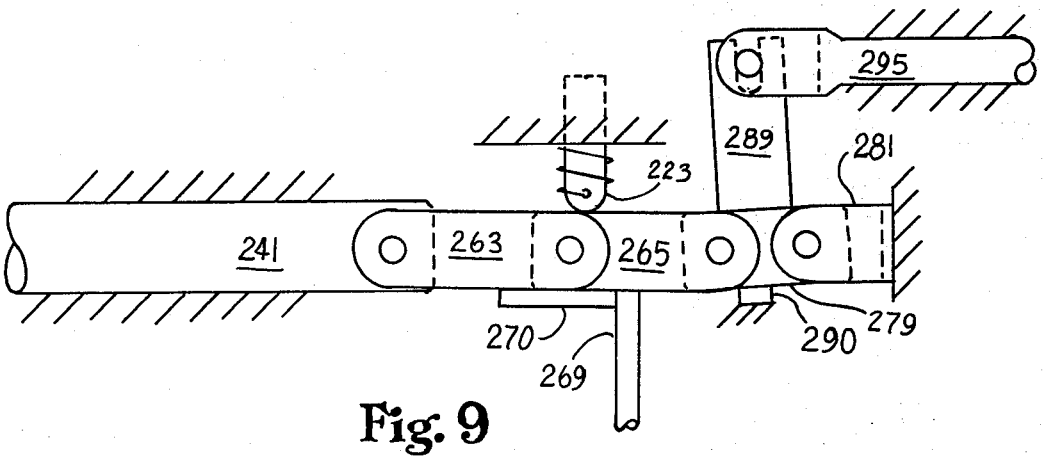
FIG. 9 is a schematic view of the linkage of FIGS. 7 and 8 with both toggle mechanisms extended and locked.

An alternative form of tandem toggle linkage may be substituted in the apparatus of FIG. 1 as shown at FIGS. 7, 8 and 9. The apparatus of FIGS. 7, 8 and 9 has only three links rather than four and thus is potentially simpler and possibly less expensive to produce. Each of the linkages has certain distinctive characteristics which may be important. The apparatus of the FIGS. 1 through 6 has proven performance capability and for specific applications would be considered a preferred embodiment.

As in the case of FIGS. 4, 5 and 6, the schematic diagrams of FIGS. 7, 8 and 9 represent three successive positions of a tandem toggle linkage for use in a clamping device. FIG. 7 shows schematically the position of the mechanism at the start of a clamping operation. Shaft 241 is retracted; in the context of FIG. 1 the jaws 19 and 45 would be open to receive a workpiece. The toggle linkage consisting of links 263 and 265 with pivotal couplings provided by pins 261, 267 and 277, is extended and locked by clockwise movement of arm 269. The stop for over center relative motion of links 263 and 265 is provided by an extension 270 on link 265 which interacts with link 263 to limit the over center misalignment of the links to a few degrees or less as illustrated in FIG. 8. It should be noted that the finger 223 does not provide an over center stop for links 263 and 265 in the apparatus of FIGS. 7 through 9. Finger 223 is spring urged by spring 222 to cause it to apply a force tending to unlock the toggle linkage including links 263 and 265, and in this respect is similar to the finger 123 in FIGS. 1 through 6.

Upon completion of the hand operation of arm 269 the apparatus will assume the position shown in FIG. 8. Although not shown in FIG. 8 the apparatus may be provided with a bleed valve 115 or other equivalent sensor for automatically actuating shaft 295 by a cylinder or other mechanism not shown. As shaft 295 moves to the left, pin 291 in clevis 293 engages the slot in slotted arm 289 and moves it and link 279 in a counter clockwise direction about pin 283. Because links 263 and 265 are locked by the engagement of extension 270 with link 263 these two links move as a unit as if they were a single link cooperating with link 279 to form a toggle link. The stop for link 279 is a fixed stop 290. Upon the full extension of shaft 295 to the point where link 279 rests on stop 290 the mechanism assumes the position shown in FIG. 9.

From FIG. 9 it will be seen that the arrangement of links and their stops in the position shown has the effect of a tandem toggle linkage, each of which is locked over center so long as shaft 295 is extended. Upon retraction of shaft 295 link 279 is rotated clockwise which immediately releases the force tending to hold links 263 and 265 locked relative to one another. This permits finger 223 under the urging of spring 222 to cause relative rotation of the links 263 and 265 about pin 267 so that they are no longer over center. Spring 257 then takes up the task of retracting the toggle linkage and incidentally restoring the arm 269 to the right where the apparatus is in its initial condition and prepared for a repetition of the foregoing cycle.

It should be noted that in going from the position shown in FIG. 9 to the position shown in FIG. 7 the apparatus will not assume precisely the position shown in FIG. 8 because unlocking of link 265 relative to link 263 will normally commence before completion of retraction of shaft 295 and a full rotation of link 279.

It may also be noted that while the greatest compression of spring 222 occurs in the position shown in FIG. 8, the operation of spring 222 is important in the position shown in FIG. 9 and thus finger 223 must have the capability of extending outwardly at least slightly beyond the position of FIG. 9. Another characteristic of the apparatus of FIGS. 7, 8 and 9 is that the arm 269 is subjected to a noticeable motion in response to the extension of shaft 295. When shaft 295 extends, link 265 and arm 269 rotate about the center of pin 261 by a few degrees. The significance of this to the operator woiuld be that at the end of the hand impelled travel of arm 269 it would be moved further by a few degrees by the power operation of shaft 295 and link 279. The apparatus of FIGS. 7 through 9 differs in this respect from the apparatus of FIGS. 1 through 6 which does not impart any noticeable motion to the operating arm as a result of operation of the power toggle (motion is less than 0.100 inch).

As in other toggle mechanisms the amount of travel and the mechanical advantage may be predetermined within wide limits by determination of the length of links 263, 265 and 279, together with the location and lengths of arm 269 and arm 289. Similarly many modifications by way of reversal of the parts and the like are possible within the scope of the invention. By way of example, arms 269 and 289 (and also arms 69 and 89) are arranged to extend in opposite directions. This is likely to be the most convenient arrangement, but there is no necessity that the two arms extend in opposite directions and they may be arranged to extend in the same direction.

In addtion to the variations and modifications of the apparatus shown and described, numerous other variations and modifications will be apparent to those skilled in the art and accordingly the scope of the invention is not to be deemed to be limited to the embodiments shown, described or suggested but is rather to be determined by reference to the appended claims.

What is claimed is:

1. Power aided clamping apparatus comprising
a base,
a movable clamp element,
means for restraining said clamp element for linear movement relative to said base,
a first toggle link pivotally attached at one end to said clamp element,
a second toggle link pivotally attached at one end to the other end of said first toggle link,
a third toggle link,
means for pivotally securing a first end of said third toggle link in a fixed position relative to said base,
means for coupling the other end of said second toggle to the other end of said third toggle link and restraining said other end of said second toggle link to linear motion relative to said base,
a lever attached to one of said first and said second toggle links for imparting motion to said clamp element relative to said base by motion of said first and second toggle links,
an arm rigidly secured to said third toggle link,
power actuation means coupled to said arm for powered actuation of said third toggle link to produce linear motion of said other end of said second toggle link,
an over center stop for said other end of said third toggle link,
means for resiliently urging said clamp element in the clamp release direction,
an over center stop for the junction of said first and second toggle links,
means for urging the junction of said first and said second toggle links away from the last said over center stop, and
means for sensing the over center position of said first and second toggle links and causing actuation of said power actuator.

2. Apparatus as recited in claim 1 wherein said power actuation means comprises a pneumatic cylinder linear actuator.

3. Apparatus as recited in claim 2 wherein said means for sensing the over center position of said first and said second toggle links is a valve connected to operate said actuator.

4. Apparatus as recited in claim 3 further including means for preventing operation of said actuator in response to said valve when said actuator is in one of its operated positions.

5. Clamping apparatus comprising
a base,
a movable clamp element,
means for restraining said clamp element for linear movement relative to said base,
a first toggle link pivotally attached at one end to said clamp element,
a second toggle link pivotally attached at one end to the other end of said first toggle link,
a third toggle link,
means for pivotally securing a first end of said third toggle link in a fixed position relative to said base,
means for coupling the other end of said second toggle link to the other end of said third toggle link and restraining said other end of said second toggle link to linear motion relative to said base,
a lever attached to one of said first and said second toggle links for imparting motion to said clamp element relative to said base by motion of said first and second toggle links,
an arm coupled to said third toggle link for actuation of said third toggle link to produce linear motion of the other end of said second toggle link,
an over center stop for said other end of said third toggle link, and
an over center stop for the junction of said first and second toggle links.

6. Apparatus as recited in claim 5 wherein said means for coupling the other end of said second toggle link to the other end of said third toggle link and restraining said other end of said second toggle link comprises a pin pivotally coupling the other end of said second toggle link to the other end of said third toggle link.

7. Apparatus as recited in claim 6 further including means for resiliently urging said clamp element in the clamp release direction.

8. Apparatus as recited in claim 5 wherein said means for coupling the other end of said second toggle link to the other end of said third toggle link and restraining said other end of said second toggle link comprises a link coupling the other end of said second toggle link to the other end of said third toggle link and a slider mechanism restraining said other end of said second toggle link to linear motion.

9. Apparatus as recited in claim 8 further including means for resiliently urging said clamp element in the clamp release direction.

10. Apparatus as recited in claim 9 further including means for urging the junction of said first and said second toggle links away from their over center stop.

* * * * *